United States Patent [19]

Wilde et al.

[11] 4,167,797

[45] Sep. 18, 1979

[54] CLOSURE CLEANING MACHINE

[75] Inventors: Sheldon L. Wilde; William N. Peller, both of Crawfordsville; Kenneth E. Dale, Lebanon, all of Ind.

[73] Assignee: H-C Industries, Inc., Crawfordsville, Ind.

[21] Appl. No.: 850,674

[22] Filed: Nov. 11, 1977

[51] Int. Cl.[2] ..... B08B 9/08

[52] U.S. Cl. ..... 15/302; 15/304; 15/306 B

[58] Field of Search ..... 15/302, 304, 306 B

[56] References Cited

U.S. PATENT DOCUMENTS

| | | | |
|---|---|---|---|
| 2,367,393 | 1/1945 | Green | 15/306 B X |
| 2,407,751 | 9/1946 | Stewart | 15/304 X |
| 3,965,523 | 6/1976 | Elliott | 15/302 |
| 4,073,029 | 2/1978 | Vassallo | 15/306 B X |

*Primary Examiner*—Christopher K. Moore

*Attorney, Agent, or Firm*—Dressler, Goldsmith, Clement, Gordon & Shore, Ltd.

[57] ABSTRACT

A crown cleaning apparatus is provided for removing impurities from the interior and exterior surfaces of crowns. The apparatus is mounted at the terminal of a crown feed track and cleans the crowns by a high velocity spray of fluid. Several gas jets dry the crowns before the crowns exit the apparatus.

3 Claims, 4 Drawing Figures

CLOSURE CLEANING MACHINE

BACKGROUND OF THE INVENTION

This invention relates to apparatus for removing impurities from crowns, bottle caps, or other closures, prior to affixing them to a container in an automated bottling plant. While crowns are specifically referred to hereinafter, the invention relates to any type of closure that may contain impurities that should be removed prior to securing them to a container.

In a typical crown bottling plant, crowns are fed through a crown feed track to machinery which affixes the crowns onto bottles which have been filled with a beverage. The crowns are disposed in a hopper from which they are directed down a track onto containers that have been previously filled. When in the hoppers, they collect dust which tends to cling to the crowns due to generated static electricity. In addition, the crowns may pick up dust particles when they travel through the crown feed track.

It is highly desirable to remove the impurities from the interior surfaces of the crown prior to affixing the crowns onto the tops of bottles containing a beverage so that the beverage does not become contaminated with the impurities carried on the interior surfaces of the crowns.

SUMMARY OF THE INVENTION

The present invention comprises a crown cleaning apparatus for removing impurities from the interior and exterior surfaces of crowns. The apparatus includes a crown feed track for transporting crowns, and a housing which is mounted on the crown feed track by latches or other securing devices. At least one section of the crown feed track defines an elongated opening which is situated on the crown feed track so that the interior surfaces of crowns carried on the track face the opening. A portion of the housing also defines an opening, and this portion abuts the portion of the crown feed track which defines its elongated opening in sealed arrangement therewith so that the opening in the housing is in communication with the opening in the track. The housing is provided with spray nozzles for cleaning and drying the crowns. A fluid spray nozzle for directing a pressurized spray of fluid onto the interior surfaces of the crowns to dislodge and remove impurities from their surfaces is disposed within the housing in communication with a fluid inlet. One or more gas spray nozzles, which are in communication with a gas inlet, are disposed within the housing below the fluid spray nozzles and direct a high velocity flow of gas to the interior and exterior surfaces of the crowns to remove fluid and impurities from their surfaces. Finally, the housing is provided with a drain for allowing fluid to exit from the apparatus.

The crown cleaner is suitably mounted on the crown feed track as close as possible to the end of the track so that the crowns do not pick up any additional dust after they have been cleaned. In the usual situation, it may be mounted on a curved portion of the crown feed track where the orientation changes from vertical to horizontal.

The crown cleaner is capable of removing a major proportion of the impurities carried on the surfaces of crowns in a crown feed track, and is especially effective in removing metal and lithographic particles. These particles pose a potential health hazard, and their content in bottled beverages is presently subject to strict limitation by the Food and Drug Administration. Thus, beverage bottles which are capped with crowns having been cleaned by the apparatus of the present invention contain significantly fewer impurities than beverages which have been capped with crowns passing uncleaned through a crown feed track.

THE DRAWINGS

DETAILED DESCRIPTION

Figure 1:
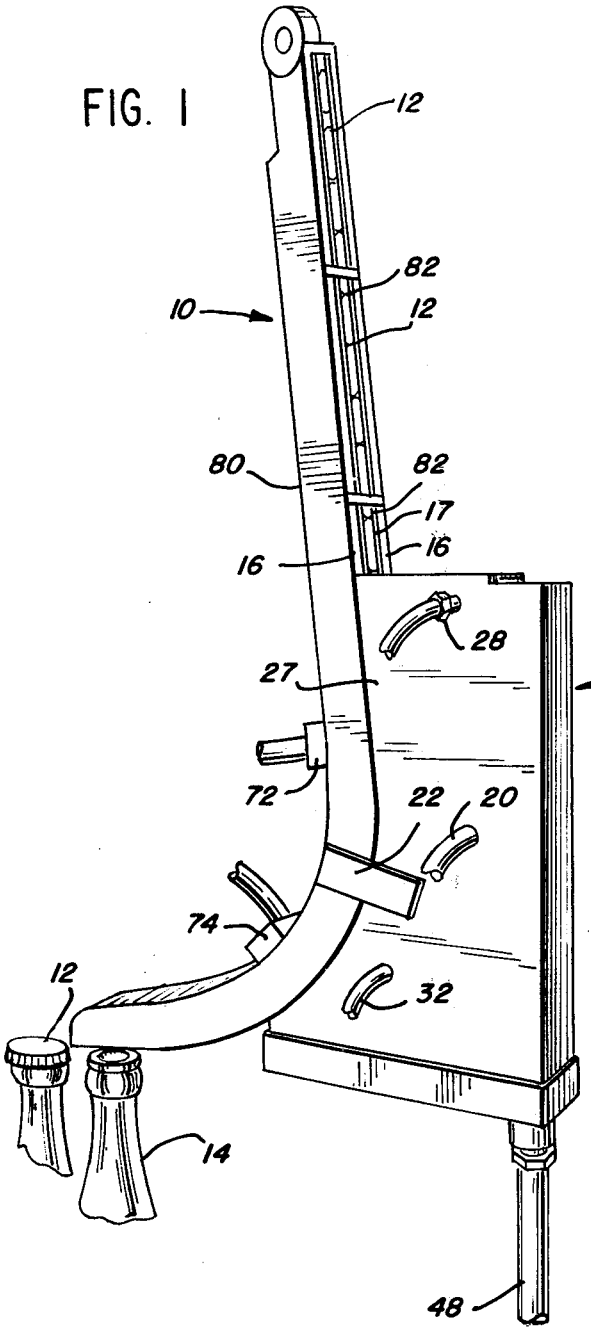
FIG. 1 is a perspective view of the apparatus of the present invention mounted on a crown feed track.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated. The scope of the invention will be pointed out in the appended claims.

As shown in FIG. 1, the crown cleaning apparatus of the present invention includes a crown feed track 10 for transporting crowns 12 so that they may be affixed to the top of bottles 14. The crown feed track 10 generally includes a back wall 80, sidewalls 81, and runners 82, all of which define a continuous slot for receiving and transporting the crowns 12. For the purposes of this invention, it is important that the back wall 80 and the sidewalls 81 be substantially gas and moisture impervious in the area where the housing 20 is mounted. At least one section 16 of the crown feed track 10 defines a first elongated opening 17. The crowns 12 are carried in the crown feed track 10 so that their interior surfaces 18 (see FIG. 3) face the opening 17.

Figure 2:
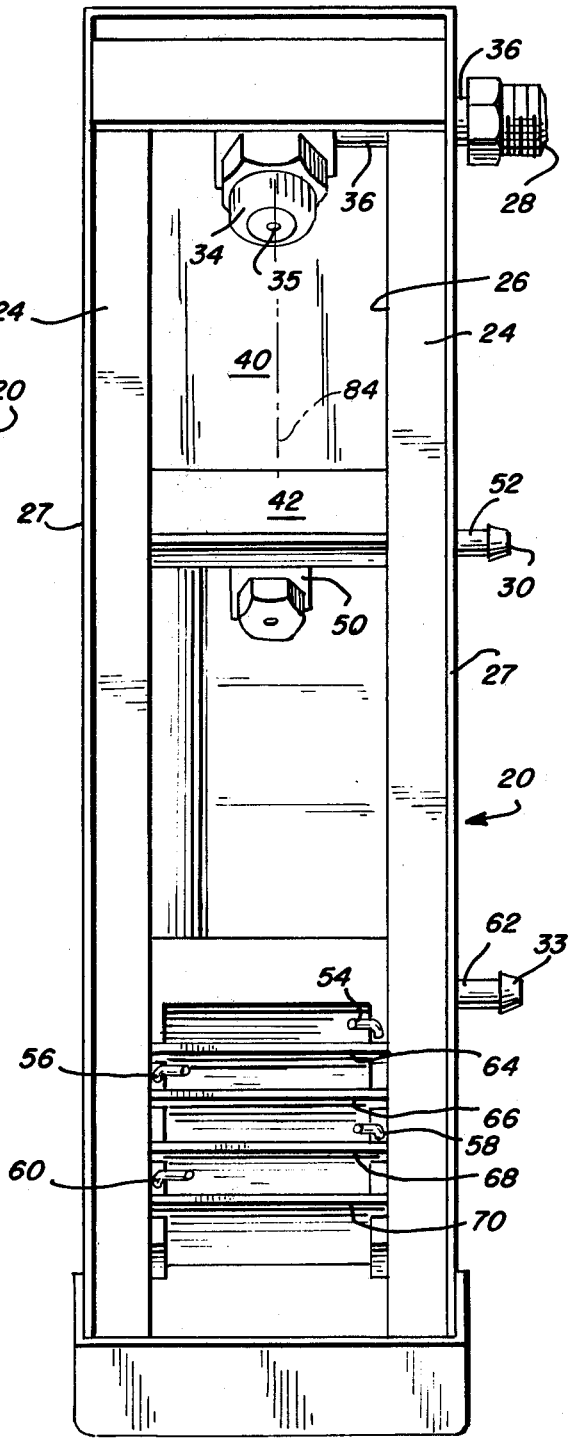
FIG. 2 is a perspective view of the apparatus of the present invention not mounted on a crown feed track.

A housing 20 is affixed to the crown feed track 10 by latches 22 or other securing devices which allow the ready mounting and dismounting of the housing 20. As is best shown in FIG. 2, a portion 24 of the housing defines elongated opening 26. When the housing is mounted on the crown feed track 10, the portion 24 of the housing which defines opening 26 abuts the portion 16 of the track which defines opening 17 in sealed arrangement therewith so that opening 26 of the housing is in communication with opening 17 of the crown feed track. In the illustrated embodiment, the housing 20 is slightly wider than the crown feed track 10, and flange portions 27 of the housing extend beyond portions 24, so that when the housing 20 is mounted on the crown feed track, the flanges 27 overlay the sidwalls 81 of the track and aid in forming a fluid tight barrier in order to insure that the fluid remains in the housing and exits the housing solely through drain pipe 48.

In order to remove the impurities from the crowns, the housing 20 is provided with fluid inlet 28 for receiving a pressurized fluid such as water. Disposed interior of the housing is fluid spray nozzle 34 for directing a pressurized spray of fluid onto the interior surfaces 18 of the crowns 12. A conduit 36 provides for communication between the fluid inlet 28 and fluid spray nozzle 34. As illustrated, the fluid spray nozzle 34 has a bore 35 of suitable size to provide an atomized spray of fluid therefrom. The nozzle 34 is angularly oriented to direct the fluid spray onto the interior surfaces 18 of the crowns 12 in order to dislodge and remove any impurities deposited thereon.

Figure 3:
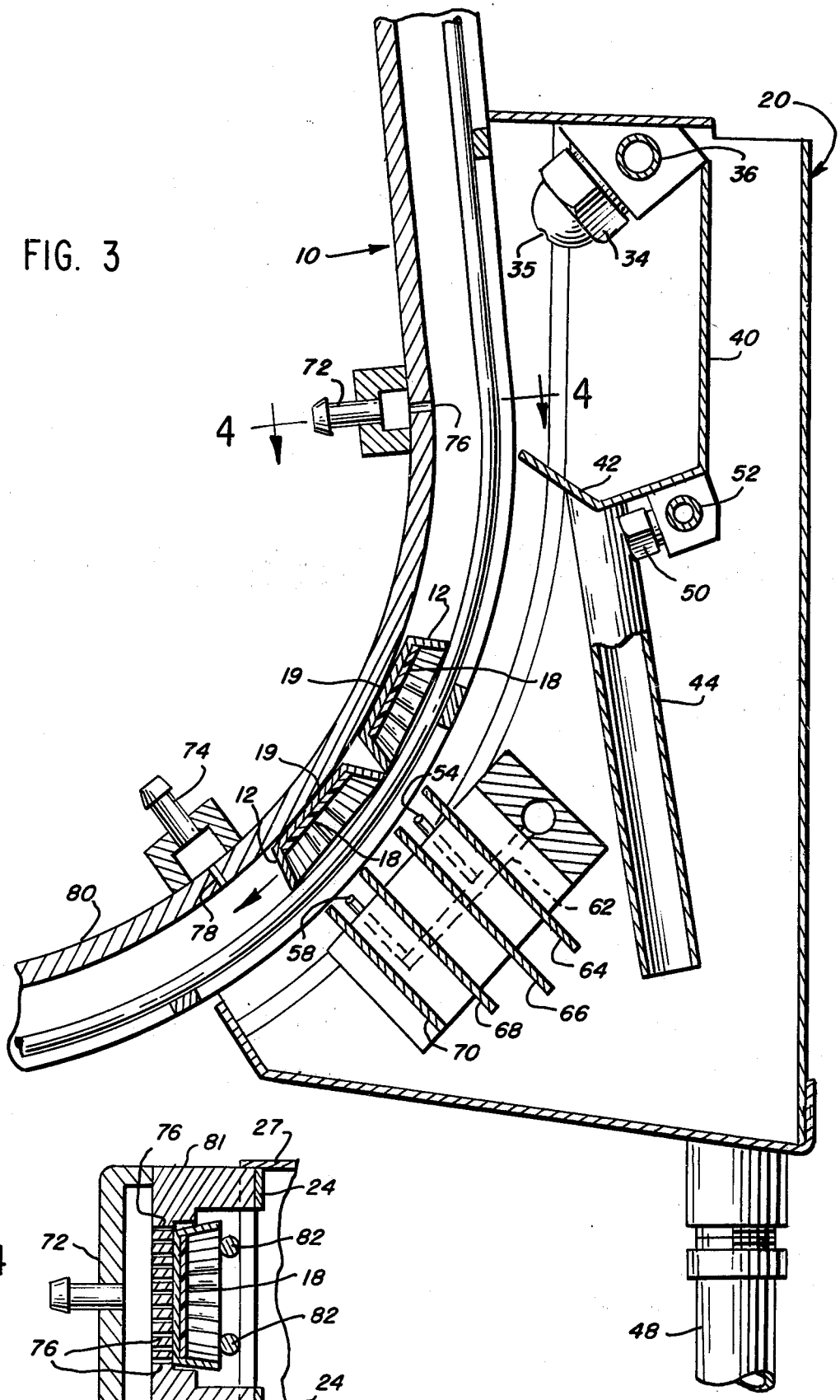
FIG. 3 is a sectional view of the apparatus of the present invention mounted on a crown feed track in the same orientation as FIG. 1.

As is best illustrated in FIG. 3, which is a cross-sectional view showing the housing 20 mounted on the crown feed track 10, the fluid spray nozzle 34 is partially enclosed by a partition 40. Partition 40 includes a section 42 which is substantially beneath the nozzle and serves to collect and to funnel the fluid to drain pipe 44 which directs the fluid to the bottom of housing 20 and ultimately to fluid drain 48, which may be a pipe or hose, or the like.

In order to dry the crowns, one or more gas spray nozzles are provided for directing a high velocity flow of gas to their interior and exterior surfaces. The gas spray nozzles include a primary air nozzle and a series of secondary air nozzles directed toward the internal surfaces of the crowns. Also included are a series of air curtain manifolds for directing a high velocity gas stream onto their external surfaces to force fluid therefrom and to create an air curtain to direct fluid into partition 40 where it can go to drain pipe 44.

In the illustrated embodiment, the primary air nozzle 50 is disposed in the housing below partition means 40. Conduit 52 provides communication between the primary air inlet 30 and the primary air nozzle 50. Primary air nozzle 50 is oriented to direct a high velocity spray of air or another suitable gas toward the inner surfaces 18 of the crowns 12 after they have been exposed to the high pressure fluid spray from fluid nozzle 34.

Mounted in the housing below the primary air nozzle 50 is a series of secondary air nozzles 54, 56, 58 and 60. These nozzles are in communication with the secondary air inlet 32 by means of a conduit 62. As is best shown in FIG. 2, each nozzle is disposed adjacent a side of the housing and is separated from each adjacent nozzle by one of air baffles 64, 66, 68, and 70. Further, each secondary air nozzle is disposed adjacent the opposite side of the housing from each adjacent nozzle so that the secondary air nozzles are alternately disposed on each of the two sides of the housing. The operation of the secondary air nozzle is explained below.

Figure 4:
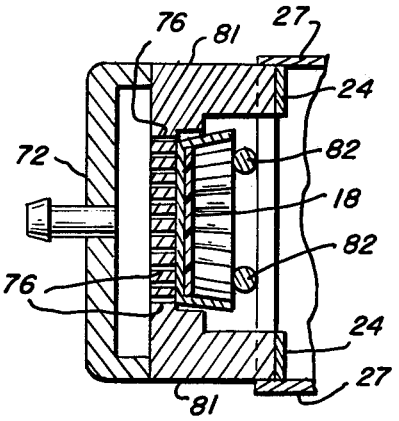
FIG. 4 is an exploded sectional view of the upper air curtain manifold.

At least one air inlet is suitably provided on the back wall 80 of the crown feed track 10. In the illustrated embodiment, two air inlet manifolds 72 and 74 are provided on the back wall 80. These manifolds are in communication with multiple openings 76 (as is shown in FIG. 4) and 78 in the back wall 80 to provide a high velocity flow of air into the crown feed track directed toward the external surfaces 19 of the crowns 12.

As is shown in the drawings, the crown cleaner is preferably attached to the crown feed track 10 just prior to the transfer point of the crown to the capping machine (not shown) of a bottling line. In the usual situation, this will be somewhere in the area of the crown feed track 10 where the crown feed track changes from a vertical orientation to a horizontal orientation.

In the operation of the present invention, impurities are removed from the interior surfaces 18 of the crowns 12 primarily by a pressurized spray of high velocity, atomized fluid angularly directed towards the internal surfaces 18 of the crowns 12 by fluid spray nozzle 34. This spray removes the loose particles of dust, dirt, lint, cardboard, dried litho material, metal, etc., which have accumulated on the crown since its manufacture. The dust is removed by both flow wetting and impingement of the dust particles by the high velocity fluid particles from the nozzle stream.

After the crowns pass out of the area of the fluid spray, they pass through several high velocity air streams. In the embodiment of the apparatus shown in the drawings, the interior surfaces 18 of the crown are first exposed to a high velocity air stream from primary air nozzle 50. This air stream serves to remove the fluid from the internal surfaces 18 of the crowns 12. The external surfaces 19 of the crowns 12 are exposed to an upper air curtain comprising high velocity jets of air from the upper air curtain manifold 72 which is communicated to the crown feed track through openings 76 in the back wall 80 of the crown feed track. This air curtain helps to separate any fluid film which has adhered to the surfaces of the crowns or to the crown feed track, and directs fluid into partition 40 and then to drain tube 44.

As the crowns pass down the track, they are next exposed to the secondary air jets 54, 56, 58, and 60. In this zone of the track, the inside surfaces 18 of the crowns 12 are swept by pinpoint jets of high velocity air alternately directed at the crowns from substantially identical but opposite angles with the horizontal, i.e., the jets are alternatively equally spaced on opposite sides of the longitudinal midline 84 of the second elongated opening 26 (FIG. 2). These jets serve to drive off any pinpoint beads of fluid still present on the inside surfaces 18 of the crowns 12. Baffles 64, 66, 68 and 70 between the jets serve to prevent flow interference in the air streams of the jets.

Finally, the crowns 12 pass through a lower air curtain provided by the high velocity air stream from the lower air curtain manifold 74 through openings 78 in the cover of the crown feed track and which serve as an extra precaution in flushing fluid particles from the external surfaces of the crowns. This lower air curtain also acts to separate any fluid film flowing down across the track, and prevents the aspiration of fluid laden air from the crown exit opening.

After the crowns 12 have passed through beyond the lower air curtain, they are preferably transferred directly to a capping machine. Means for providing for such transfer such as air jets may be provided in the housing 20 or may be provided separately from the housing depending on the overall design of the crown feed track, and the location of the apparatus of the present invention with respect to the longitudinally oriented portion of the crown feed track. When the air jets are not part of the housing 20 the crowns can be transferred even if housing 20 is removed from track 10.

Although the apparatus of this invention has been described and illustrated in connection with the cleaning of crowns for bottles, it may be used to clean any closure means having internal and external surfaces which are fed down a passageway. When used in the claims, the word "crown" defines any closure means having internal and external surfaces. Similarly, "crown feed track" is intended to define any passage means for transporting such closure means. When the invention is employed with closures of other designs the details of the closure feeding mechanism, relative angle and placement of cleaning components within the apparatus will be designed to accommodate the particular closure to be cleaned.

It is, of course, intended to cover by the appended claims all such modification as fall within the true spirit and scope of the invention.

What is claimed is:

1. Apparatus for removing impurities from closures having interior and exterior surfaces comprising:

a generally vertically disposed closure feed track for transporting closures in a generally downward direction, at least one section of the closure feed track defining a first elongated opening, the closures carried in the closure feed track so that the interior surfaces of the closures face the opening, a housing, a second elongated opening defined by a portion of the housing, the portion of the housing defining the second elongated opening abutting the portion of the closure feed track defining the first elongated opening in sealed arrangement therewith, whereby the second elongated opening is in communication with the first elongated opening, means for securing the housing to the closure feed track, the housing provided with liquid inlet means for receiving a pressurized liquid and gas inlet means for receiving a high velocity flow of gas, liquid spray means for directing a pressurized spray of liquid onto the interior surfaces of the closures to dislodge and remove impurities from the surfaces of the closures, the liquid spray means disposed within the housing in communication with the liquid inlet means, a plurality of gas spray means for directing a high velocity flow of gas to the interior and exterior surfaces of the closures disposed below the liquid spray means, said gas spray means including, (1) first means disposed in the housing below the liquid spray means for directing a high velocity gas stream against the internal surfaces of the closure to force liquid therefrom, (2) second means disposed on the closure feed track for directing a high velocity gas stream onto the external surfaces of the closure to force liquid therefrom and to create an air curtain to direct liquid into the housing, and (3) third means disposed in the housing below the first means for directing multiple jets of high velocity gas into the interior of the closure and including a series of air nozzles, with each nozzle being disposed adjacent a side of the housing and separated from each adjacent nozzle by an air baffle, and means for draining liquid from the apparatus.

2. Apparatus for removing impurities from crowns having interior and exterior surfaces comprising:

a generally vertically disposed crown feed track for transporting crowns in a generally downward direction, at least one section of the crown feed track defining a first elongated opening, the crown carried in the crown feed track so that the interior surfaces of the crowns face the opening, a housing, a second elongated opening defined by a portion of the housing, the portion of the housing defining the second elongated opening abutting the portion of the crown feed track defining the first elongated opening in sealed arrangement therewith, whereby the second elongated opening is in communication with the first elongated opening, means for securing the housing to the crown feed track, the housing provided with liquid inlet means for receiving a pressurized liquid and a plurality of gas inlet means for receiving a high velocity flow of gas, liquid spray means for directing a pressurized spray of liquid onto the interior surfaces of the crowns to dislodge and remove impurities from the surfaces of the crowns, the liquid spray means disposed within an upper part of the housing and in communication with the liquid inlet means, partition means disposed in and defining an upper part of the housing and partially enclosing the liquid spray means, means for collecting liquid from the liquid spray means that collects in the upper part of the housing, and means for draining the liquid from the upper part of the housing, first means for directing a high velocity gas stream onto the internal surfaces of the crowns to force liquid therefrom, the first means disposed in the housing below the partition means, second means for directing a high velocity gas stream onto the external surfaces of the crowns to force liquid therefrom and to create an air curtain to direct liquid into said housing, the second means disposed on the crown feed track, third means for directing multiple jets of high velocity gas onto the interior surfaces of the crowns, the third means disposed in the housing below the first and second means comprising a series of air nozzles, each nozzle disposed adjacent a side of the housing and separated from each adjacent nozzle by an air baffle, and means for draining liquid from the apparatus.

3. Apparatus for removing impurities from closures having interior and exterior surfaces comprising:

a generally vertically disposed closure feed track for transporting closures in a generally downward direction, at least one section of the closure feed track defining a first elongated opening, the closures carried in the closure feed track so that the interior surfaces of the closures face the opening, a housing, means for securing the housing to the closure feed track, the housing provided with liquid inlet means for receiving a pressurized liquid and gas inlet means for receiving a high velocity flow of gas, liquid spray means for directing a pressurized spray of liquid onto the interior surfaces of the closures to dislodge and remove impurities from the surfaces of the closures, the liquid spray means disposed within the housing in communication with the liquid inlet means, a plurality of gas spray means for directing a high velocity flow of gas to the interior and exterior surfaces of the closures disposed below the liquid spray means, the gas spray means including a series of air nozzles with each nozzle being disposed adjacent a side of the housing and separated from each adjacent nozzle by an air baffle, with each nozzle disposed on the opposite side of the housing from each adjacent nozzle, and means for draining liquid from the apparatus.

* * * * *